United States Patent [19]

Ramsey

[11] Patent Number: 4,676,078

[45] Date of Patent: Jun. 30, 1987

[54] APPARATUS FOR SPRAY DYEING

[75] Inventor: Ernest B. Ramsey, Rocky Face, Ga.

[73] Assignee: West Point Pepperell, Inc., West Point, Ga.

[21] Appl. No.: 767,837

[22] Filed: Aug. 20, 1985

[51] Int. Cl.[4] ..... D06B 1/02; D06B 11/00

[52] U.S. Cl. ..... 68/205 R

[58] Field of Search ..... 68/205 R; 118/313–316; 239/587

[56] References Cited

U.S. PATENT DOCUMENTS 1,919,798 7/1933 MacLaurin ..... 118/314
2,218,811 10/1940 Chaussabel ..... 68/205 R X
2,804,764 9/1957 Runton ..... 68/205 R X
4,341,098 7/1982 Otting ..... 68/205 R

*Primary Examiner*—Philip R. Coe
*Attorney, Agent, or Firm*—Cushman, Darby & Cushman

[57] ABSTRACT

An arrangement is disclosed for depositing a color spray pattern on a substrate, such as a carpet. A plurality of dye bars are employed, each feeding a separate row of control valves. The valves are mounted on separate headers which are displaceable through an arc so that the spray of dye passed from each valve through an associate nozzle can be varied from the perpendicular. The result is a variation in spray pattern width and penetration on the substrate.

3 Claims, 2 Drawing Figures

APPARATUS FOR SPRAY DYEING

BACKGROUND OF THE INVENTION

It is well known to employ jets of dye to provide color patterns on substrates of material, such as carpeting. Typically, several groups of nozzles are used for this purpose, each group being supplied with a separate color. Between the color sources and the respective nozzles, valves are interposed so that by selective operation of the valves, a desired color pattern can be sprayed onto the substrate. Control of the pattern is accomplished through any one of a variety of means such as mechanical cams and drums, punched tape, programmable controllers, computers and the like.

Heretofore, the nozzles utilized in such color pattern spray arrangements have been located in a fixed position. The present invention provides for the nozzles to be selectively moved through an arc, or to be held at any position within the arc's range.

SUMMARY OF THE INVENTION

A plurality of groups of spray nozzles are arranged such that each group is connected to a separate dye bar supplied by a different liquid dye. Feed lines run from the dye bars to the associated spray nozzles through valves which are individually controlled. Each valve is mounted on a header, and each header is pivotally supported whereby a header can be rotated through an arc to vary the angle of impact of spray from its associated nozzles onto the substrate. The headers are individually rotatable under the control of a programmable operator, whereby an infinite permutation of selective positionings and angular displacements of the associated nozzles can be obtained.

By selectively moving each header through an arc, the sprays from its associated nozzles can be varied in orientation as they impact the substrate. Such variation changes both the width of the jets contacting the substrate and the degree of dye penetration.

DETAILED DESCRIPTION OF THE INVENTION

Figure 2:
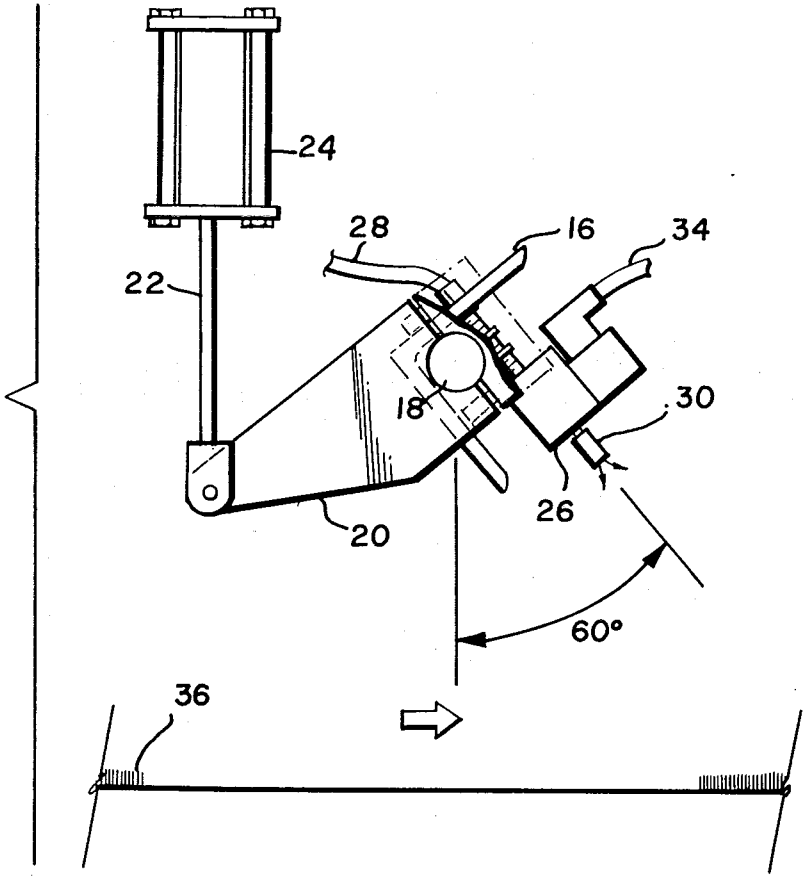
Figure 1:
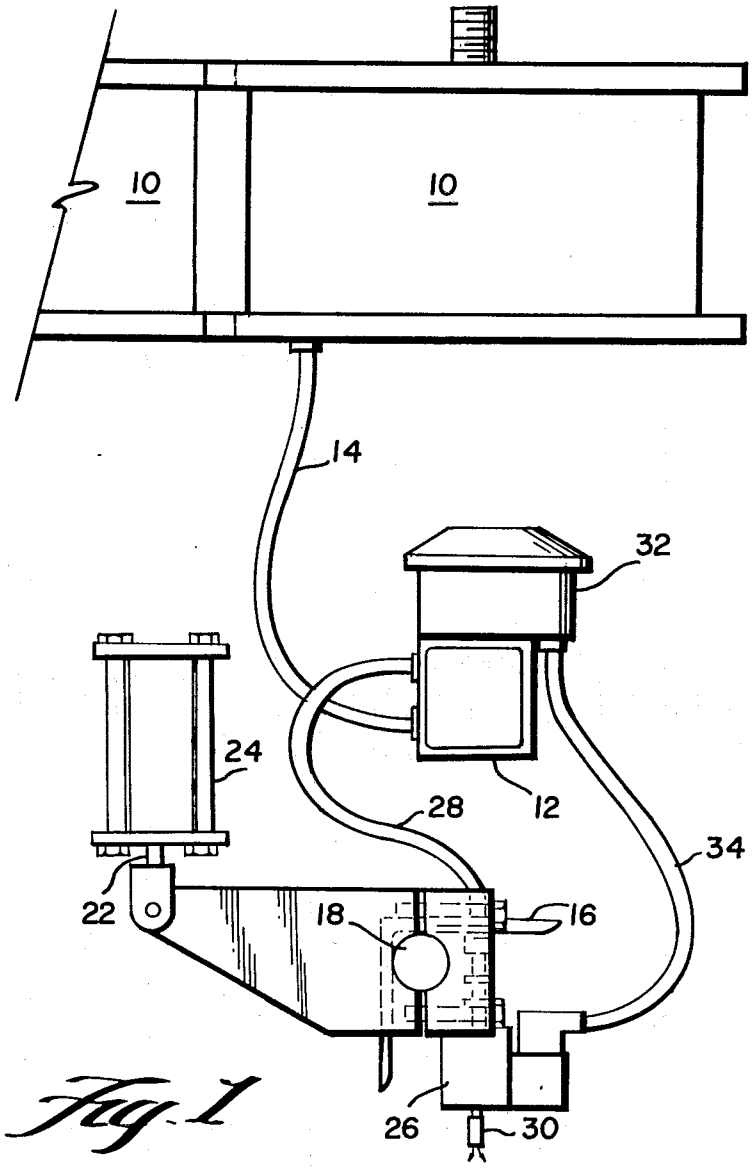

The invention will be described in further detail with respect to the accompanying drawing wherein:

FIG. 1 is a side elevational view of a color spray pattern arrangement according to the invention; and FIG. 2 is a detailed side elevational view of a mechanism for selectively moving a group of spray nozzles through an arc.

Referring to FIG. 1, the invention includes a plurality of dye distribution heads 10. For convenience of illustration, only one head is shown in its entirety. Liquid dye of different colors is delivered by pumps (not shown) to the respective dye distribution heads 10. The flow rate and pressure are controlled to obtain the desired spray patterns.

A color bar 12 is associated with each of the distribution heads 10. The bar's length substantially corresponds to the width of the substrate which is to be treated. A feed line 14 directs dye from a head 10 to its associated color bar 12. As a result, the color bar is filled with dye over its entire length.

A header 16 is provided proximate each of the color bars, the header corresponding in length to its associated bar. The headers 16 are secured to respective shafts 18 which are journalled at their ends to a frame (not shown). One end of an arm 20 is clamped to each shaft 18. The opposite end of each arm 20 is pivotally joined to the end of a piston rod 22 associated with a conventional hydraulic valve 24. When the valve 24 is actuated, the associated header 16 is displaced through an arc.

Each header 16 supports a group of valves 26 arranged in spaced relationship along their respective header. Dye from the color bar 12 is directed to each valve 26 of a group by lines 28. A nozzle 30 is associated with each valve 26. When a valve 26 is opened, dye from color bar 12 passes through line 28 and the valve so as to be discharged from the related nozzle 30 in a fan-shaped spray. Excess dye is returned to a reservoir 32 associated with the color bar through a return line 34.

The individual valves 26 are conventionally controlled by any one of several devices (not shown) including mechanical cams and drums, punched tape, programmable controllers, computers and the like. Operation of the hydraulic valves 24 are similarly controlled on an individual basis. As a result, the flow of dye through any one of the nozzles 30 is established by the selective actuation of its associated valve 26, and the orientation of the spray, as it impacts onto a substrate, is selectively varied in accordance with the actuation of the corresponding hydraulic valve 24.

In FIG. 2, a substrate 36, such as a carpet, is illustrated as moving beneath nozzles 30, and the nozzles have been displaced in the direction of substrate movement through an arc of 60° by selective actuation of the hydraulic valve 24. As a consequence, instead of the pressurized sprays of dye from the nozzles impacting the substrate at right angles so as to deeply penetrate the substrate, the angle of impact is 30°. This results in a lesser penetration of the dye. Furthermore, the distance from the nozzles to the area of impact of the dye onto the substrate is twice as far when the nozzles are displaced 60° than is the case when they are arranged to spray the substrate perpendicular to the substrate's surface. Since the spray from each nozzle has a fan-like configuration, this means that when the nozzles are moved through an arc, the sprays grow increasingly wider as they hit the substrate.

By controlling both the application of dye from selected nozzles and the orientation of the dye sprays by selectively displacing the nozzles through an arc in the direction of substrate movement, the patterns which may be achieved are greatly increased so that many more interesting effects can be obtained than is the case when the nozzles are fixed. Of course, any of the groups of nozzles can be held at a fixed location within the range of the arc.

What is claimed is:

1. Apparatus for spray dyeing a moving substrate comprising:

a plurality of groups of nozzles, each group being connected to a source of dye of different color;

selectively controlled valve means joined in operative relationship between each nozzle and its respective dye source for individually controlling the discharge of dye from said nozzles;

means for pivotally supporting each group of nozzles; and means for selectively displacing each group of nozzles about its pivotal support in an arc extending in the direction of movement of said substrate while the substrate is being dyed.

2. Apparatus according to claim 1 wherein the nozzles of each group are secured in spaced relationship to their respective supporting means and extend in a direction transverse to the direction of movement of said substrate.

3. Apparatus according to claim 2 wherein said displacing means comprises an arm secured at one end to the supporting means and connected at its other end to a piston rod of a selectively actuated hydraulic cylinder.

* * * * *